US009643069B2

(12) United States Patent
Nomura

(10) Patent No.: US 9,643,069 B2
(45) Date of Patent: May 9, 2017

(54) SENSOR UNIT AND MOTION DETECTION DEVICE

(71) Applicant: SEIKO EPSON CORPORATION, Tokyo (JP)

(72) Inventor: Kazuo Nomura, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 160 days.

(21) Appl. No.: 14/454,168

(22) Filed: Aug. 7, 2014

(65) Prior Publication Data

US 2015/0042481 A1 Feb. 12, 2015

(30) Foreign Application Priority Data

Aug. 8, 2013 (JP) ..... 2013-164823

(51) Int. Cl.

*G08B 21/00* (2006.01)
*A63B 69/36* (2006.01)
*A63B 71/06* (2006.01)

(52) U.S. Cl.

CPC .. *A63B 69/3632* (2013.01); *A63B 2071/0655* (2013.01); *A63B 2220/40* (2013.01); *A63B 2220/803* (2013.01); *A63B 2220/833* (2013.01); *A63B 2225/50* (2013.01)

(58) Field of Classification Search

CPC ..... A63B 69/3632
USPC ..... 340/669
See application file for complete search history.

(56) References Cited

U.S. PATENT DOCUMENTS

| | | | | |
|---|---|---|---|---|
| 7,602,301 | B1 * | 10/2009 | Stirling | A61B 5/1127 340/573.1 |
| 8,897,959 | B1 * | 11/2014 | Sweney | B60W 50/16 701/36 |
| 2009/0247312 | A1 * | 10/2009 | Sato | A63B 69/3632 473/223 |
| 2011/0081981 | A1 * | 4/2011 | Okamoto | A63B 69/0002 473/233 |
| 2012/0249327 | A1 * | 10/2012 | Kofford | E05F 15/2076 340/539.23 |

FOREIGN PATENT DOCUMENTS

| | | |
|---|---|---|
| JP | A-11-169499 | 6/1999 |
| JP | A-2004-024488 | 1/2004 |
| JP | A-2008-073210 | 4/2008 |
| JP | A-2009-125507 | 6/2009 |
| JP | A-2009-240677 | 10/2009 |
| JP | A-2010-011926 | 1/2010 |
| JP | A-2010-110382 | 5/2010 |

* cited by examiner

*Primary Examiner* — Kerri McNally
(74) *Attorney, Agent, or Firm* — Oliff PLC

(57) ABSTRACT

A sensor unit includes a sensor section adapted to detect a motion, and an announcement section adapted to announce a state of an output signal of the sensor section.

14 Claims, 9 Drawing Sheets

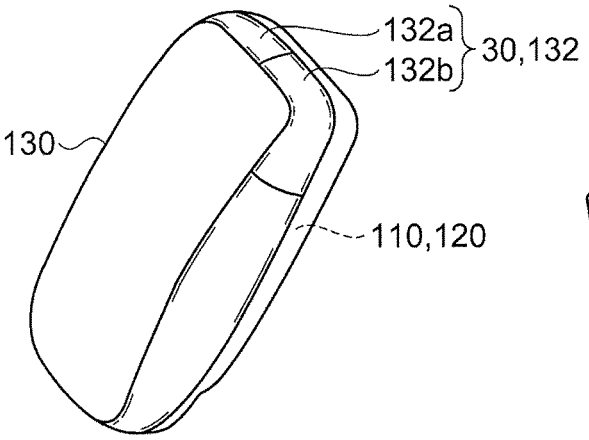
FIG. 3A
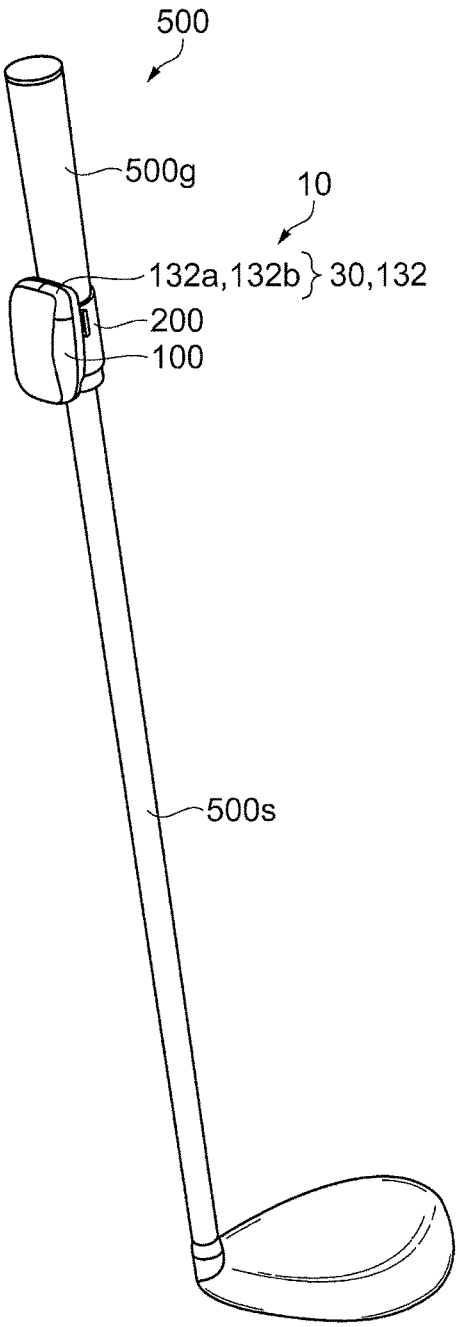
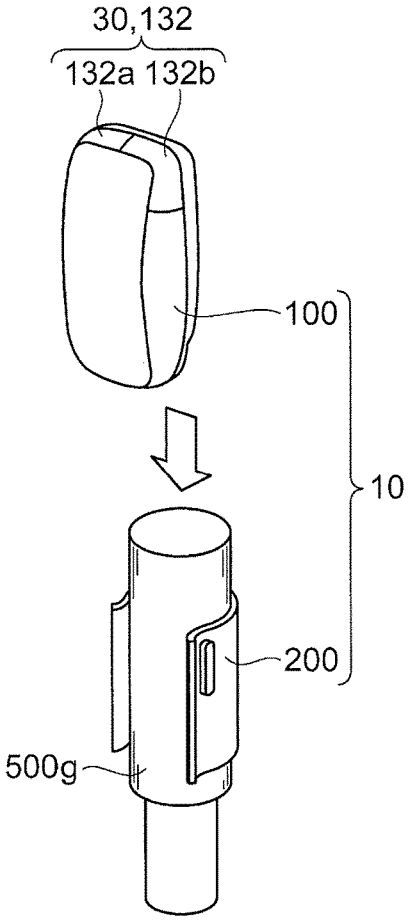
FIG. 3C
FIG. 3B

| ANNOUNCEMENT CLASS | LIGHT EMITTING SECTION | EMISSION COLOR | ANNOUNCEMENT (BLINKING) PATTERN |
|---|---|---|---|
| 1 | FIRST LIGHT EMITTING SECTION | RED | |
| | SECOND LIGHT EMITTING SECTION | RED | |
| 2 | FIRST LIGHT EMITTING SECTION | RED | |
| | SECOND LIGHT EMITTING SECTION | GREEN | |
| 3 | FIRST LIGHT EMITTING SECTION | GREEN | |
| | SECOND LIGHT EMITTING SECTION | RED | |
| 4 | FIRST LIGHT EMITTING SECTION | GREEN | |
| | SECOND LIGHT EMITTING SECTION | GREEN | |
| 5 | FIRST LIGHT EMITTING SECTION | RED | |
| | SECOND LIGHT EMITTING SECTION | RED | |
| 6 | FIRST LIGHT EMITTING SECTION | RED | |
| | SECOND LIGHT EMITTING SECTION | GREEN | |
| 7 | FIRST LIGHT EMITTING SECTION | GREEN | |
| | SECOND LIGHT EMITTING SECTION | RED | |
| 8 | FIRST LIGHT EMITTING SECTION | GREEN | |
| | SECOND LIGHT EMITTING SECTION | GREEN | |

FIG. 6

| ANNOUNCEMENT CLASS | ACOUSTIC SECTION | PITCH | ANNOUNCEMENT (SOUNDING) PATTERN |
|---|---|---|---|
| 11 | FIRST ACOUSTIC SECTION | HIGH NOTE | |
| | SECOND ACOUSTIC SECTION | LOW NOTE | |
| 12 | FIRST ACOUSTIC SECTION | HIGH NOTE | |
| | SECOND ACOUSTIC SECTION | LOW NOTE | |
| 13 | FIRST ACOUSTIC SECTION | HIGH NOTE | |
| | SECOND ACOUSTIC SECTION | LOW NOTE | |
| 14 | FIRST ACOUSTIC SECTION | HIGH NOTE | |
| | SECOND ACOUSTIC SECTION | LOW NOTE | |
| 15 | FIRST ACOUSTIC SECTION | HIGH NOTE | |
| | SECOND ACOUSTIC SECTION | LOW NOTE | |
| 16 | FIRST ACOUSTIC SECTION | HIGH NOTE | |
| | SECOND ACOUSTIC SECTION | LOW NOTE | |
| 17 | FIRST ACOUSTIC SECTION | HIGH NOTE | |
| | SECOND ACOUSTIC SECTION | LOW NOTE | |
| 18 | FIRST ACOUSTIC SECTION | HIGH NOTE | |
| | SECOND ACOUSTIC SECTION | LOW NOTE | |

FIG. 8

SENSOR UNIT AND MOTION DETECTION DEVICE

CROSS REFERENCE

The entire disclose of Japanese Patent Application No. 2013-164823 filed Aug. 8, 2013 is expressly incorporated by reference herein.

BACKGROUND

1. Technical Field

The present invention relates to a sensor unit and a motion detection device.

2. Related Art

In recent years, a device for analyzing a motion of a test object (a human) has been demanded in a variety of fields.

By analyzing the motion form of the test object (an athlete) such as a trajectory of a swing of sports equipment such as a golf club, tennis racket, or a baseball bat to thereby select the sports equipment suitable for the test object and improve the motion form based on the analysis result, improvement in athletic ability can be achieved.

As such an analysis device and an analysis method of the motion, for example, JP-A-2010-110382 discloses a motion detection device using an optical motion capture device and an analysis method. The device is for shooting a measurement target object (a test object and sports equipment) attached with a marker using an infrared camera or the like, and then calculating the movement trajectory of the marker using the image thus shot to thereby analyze the motion.

Further, as the analysis device and the analysis method of a motion, for example, JP-A-2008-73210 discloses a motion detection device and an analysis method for detecting the motion of the test object due to a swing of sports equipment using an inertia sensor attached to the test object, and then analyzing the motion based on the motion data of the test object output from the inertia sensor. Such a device does not require a motion capture device such as an infrared camera, and therefore, has an advantage that handling is simple and easy.

Here, when detecting the motion of the test object using an angular velocity sensor or the like as the inertia sensor and then analyzing the motion, it is required to remove a bias of the inertia sensor. In other words, it is required to determine an origin of the motion of the test object.

The bias is a collective term including a zero bias occurring in the initial state prior to the start of the motion of the test object and in which the angular velocity is zero, and a drift due to an external factor such as a power supply fluctuation or a temperature fluctuation.

In order to remove the bias, it is required to obtain a bias value in the initial state. For example, in the swing analysis of a golf club, a rest period in which the test object stops is set before starting the swing. Then, the bias value in the initial state is determined based on a signal output from the angular velocity sensor or the like in the rest period. In other words, the origin of the motion of the test object is determined.

However, since the motion (swing) is started after visually checking a display device of the analysis device in order to confirm that the bias value and the origin of the motion are determined, there is a possibility that the appropriate swing analysis cannot be achieved due to the deviation of the visual line of the test object. Further, in the case of adopting a method in which other people than the test object checks the display device and the motion (swing) is started in response to a sign such as a voice, since other people than the test object are involved, there is a problem of lacking convenience of the motion analysis.

SUMMARY

An advantage of some aspects of the invention is to solve at least a part of the problems described above, and the invention can be implemented as following forms or application examples.

Application Example 1

A sensor unit according to this application example includes a sensor section adapted to detect a motion of a measurement object, and an announcement section adapted to announce a state of an output signal of the sensor section.

According to such a sensor unit, there is provided the announcement section adapted to announce the state of the output signal of the sensor section for detecting the motion of the measurement object. Therefore, in the case of detecting the motion of the test object due to the swing of the sports equipment using the sensor unit, it is possible for the test object gripping the sports equipment to sense the state of the output signal of the sensor section without losing the posture. Therefore, according to such a sensor unit, in the case in which the test object grips the sports equipment and makes a motion (swing), the reliability of the detection of the motion can be enhanced.

Application Example 2

In the sensor unit according to the application example described above, it is preferable that the announcement section announces whether or not the measurement object of the sensor section is in a rest state.

According to such a sensor unit, it is possible to detect the motion of the measurement object with the sensor section, and then announce that the measurement object is in the rest state. Therefore, in the case of detecting the motion of the test object due to the swing of the sports equipment, since the test object senses the rest state, and then starts the motion, the bias in the output signal of the sensor section in the rest state can be removed.

Application Example 3

In the sensor unit according to the application example described above, it is preferable that the announcement section performs a first determination on whether or not a value of an output signal of the sensor section becomes lower than a first threshold value in a predetermined period, and announces whether or not the first determination is positive.

According to such a sensor unit, the first determination on whether or not the value of the output signal of the sensor section becomes lower than the first threshold value is continuously performed for a predetermined period, and then the announcement section can announce the result. Therefore, by using the output value of the sensor section when the measurement object is in the rest state as the first threshold value, the determination on whether or not the measurement object is in the rest state can continuously be performed for a predetermined period.

Therefore, by starting the motion after sensing the fact that the rest state lasts for a predetermined period, the accuracy of removal of the bias in the output signal of the sensor section in the rest state can be enhanced.

Application Example 4

In the sensor unit according to the application example described above, it is preferable that the announcement section performs a second determination on whether or not a value of an output signal of the sensor section exceeds a second threshold value, and announces whether or not the second determination is positive.

According to such a sensor unit, the second determination on whether or not the value of the output signal of the sensor section exceeds the second threshold value is performed, and then the announcement section can announce the result. Therefore, by using the maximum detectable output value of the sensor section in detecting the motion of the measurement object, or an output value corresponding to the preferable motion as the second threshold value, it is possible to perform the determination on the fact that the motion of the measurement object causes an overrange with respect to the measurement range of the sensor section, or on the fact that the motion of the measurement object is preferable.

Application Example 5

In the sensor unit according to the application example described above, it is preferable that the announcement section announces whether or not transmission of an output signal of the sensor section to another device connected to the sensor unit is complete.

According to such a sensor unit, the announcement section can announce whether or not the transmission of the output signal of the sensor section to another device connected to the sensor unit is complete.

Therefore, it is possible to make the test object performing the swing of the sports equipment to be the measurement object sense the fact that the output signal due to the motion detected by the sensor section has been transmitted to other devices, and thus the subsequent measurement can promptly be performed.

Application Example 6

In the sensor unit according to the application example described above, it is preferable that the announcement section makes an announcement using at least one of light, a sound, and a vibration.

According to such a sensor unit, by announcing the state of the output signal of the sensor section using at least one of the light and the sound, the announcement section can make the test object performing the swing of the sports equipment to be the measurement object visually or aurally sense the state.

Application Example 7

In the sensor unit according to the application example described above, it is preferable that there is further included a housing adapted to house the sensor section, and at least a part of the announcement section is disposed on a side surface of the housing.

According to such a sensor unit, since the announcement section is disposed on the side surface of the housing, the announcement by the announcement section can easily be sensed from the outside of the sensor unit. Therefore, it is possible to make the test object performing the swing of the sports equipment to be the measurement object easily sense the announcement by the announcement section.

Application Example 8

In the sensor unit according to the application example described above, it is preferable that there is further included a holding section adapted to attach the housing to the measurement object, and at least a part of the announcement section is provided across ends of the holding section.

According to such a sensor unit, the sensor unit is attached to the measurement object via the holding section, and the announcement section is provided to the holding section. Therefore, it is possible to make the test object sense the announcement by the announcement section provided to the holding section irrespective of the attachment position of the sensor unit.

Application Example 9

A motion detection device according to this application example includes the sensor unit described above, and an analysis unit adapted to analyze the motion of the measurement object.

According to such a motion detection device, the sensor unit is provided to the measurement object. The sensor unit is provided with the announcement section for announcing the state of the motion detection device and the state of the output signal from the sensor section based on the motion of the measurement object. Therefore, when detecting the motion of the test object due to the swing of the sports equipment using the sensor unit, it is possible for the test object gripping the sports equipment to sense the state of the output signal of the sensor section without losing the posture. Therefore, according to such a motion detection device, in the case in which the test object grips the sports equipment and makes a motion (swing), the reliability of the analysis of the motion can be enhanced.

Application Example 10

In the motion detection device according to the application example described above, the sensor unit transmits an output signal of the sensor section to the analysis unit, the analysis unit analyzes the output signal, and then transmits a trigger signal to the announcement section of the sensor unit when a predetermined condition representing the state of the output signal is fulfilled, and the announcement section makes an announcement upon reception of the trigger signal.

According to such a motion detection device, the announcement section can receive the trigger signal representing the state of the output signal in the analysis unit, and then announce the state of the output signal in the analysis unit based on the trigger signal. Therefore, it is possible to make the test object sense the fact that the output signal of the sensor section has been transmitted to the analysis unit, and at the same time, prompt the test object to start the subsequent measurement or to redo the measurement.

BRIEF DESCRIPTION OF THE DRAWINGS

The invention will be described with reference to the accompanying drawings, wherein like numbers reference like elements.

FIGS. 3A through 3C are diagrams schematically showing the motion detection device applied to sports equipment according to the first embodiment.

FIG. 6 is a diagram showing an example of announcement patterns of an announcement section according to the first embodiment.

FIG. 8 is a diagram showing an example of announcement patterns of an announcement section according to the second embodiment.

DESCRIPTION OF EXEMPLARY EMBODIMENTS

Figure 1:
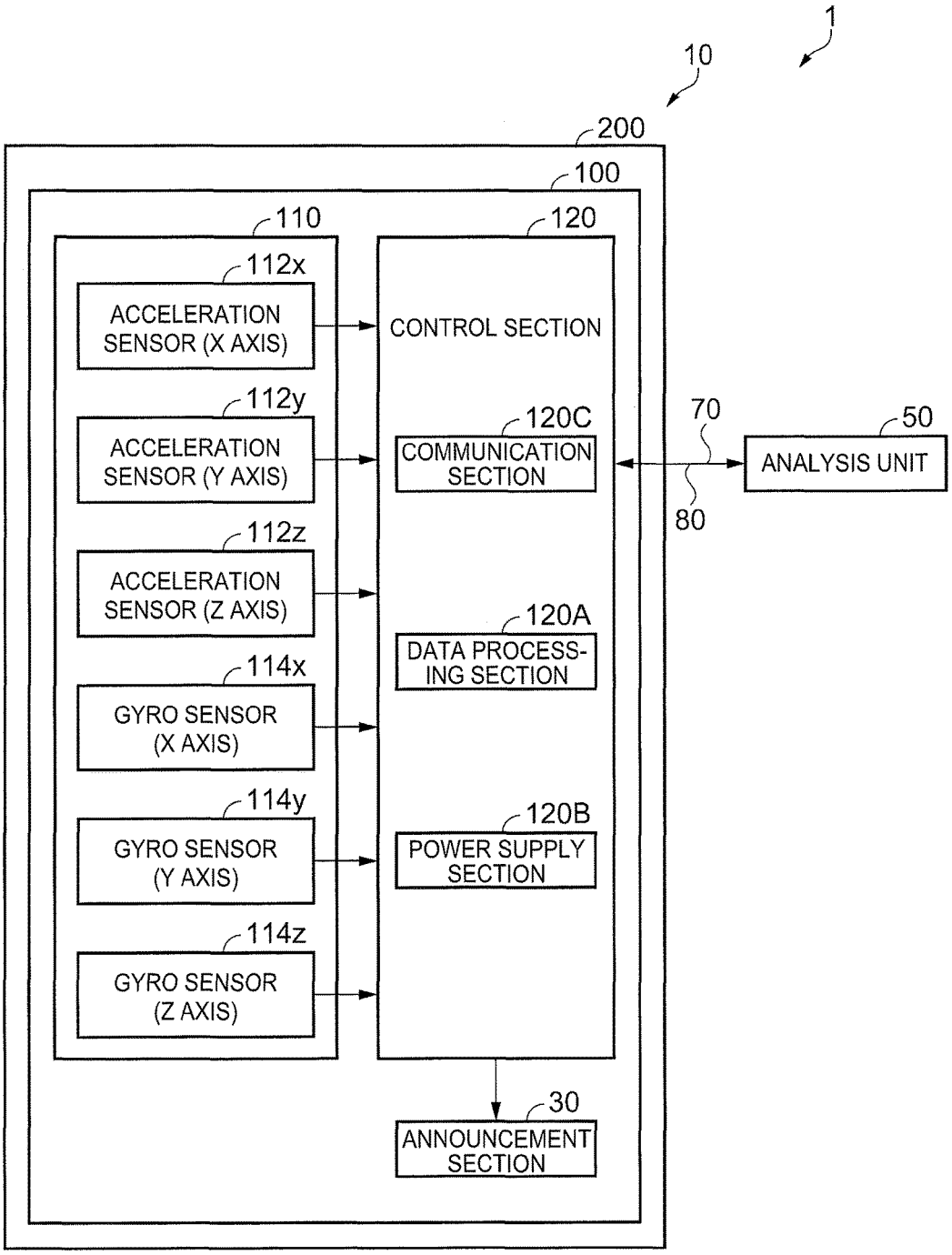
FIG. 1 is a block diagram showing a schematic configuration of a motion detection device according to a first embodiment of the invention centered on a sensor unit.

Hereinafter, some embodiments of the invention will be explained with reference to the accompanying drawings. It should be noted that in the drawings described hereinafter, the dimensions and the ratios of the constituents are arbitrarily made different from those of the actual constituents in some cases in order to provide the constituents with recognizable sizes in the drawings.

First Embodiment

Figure 4:
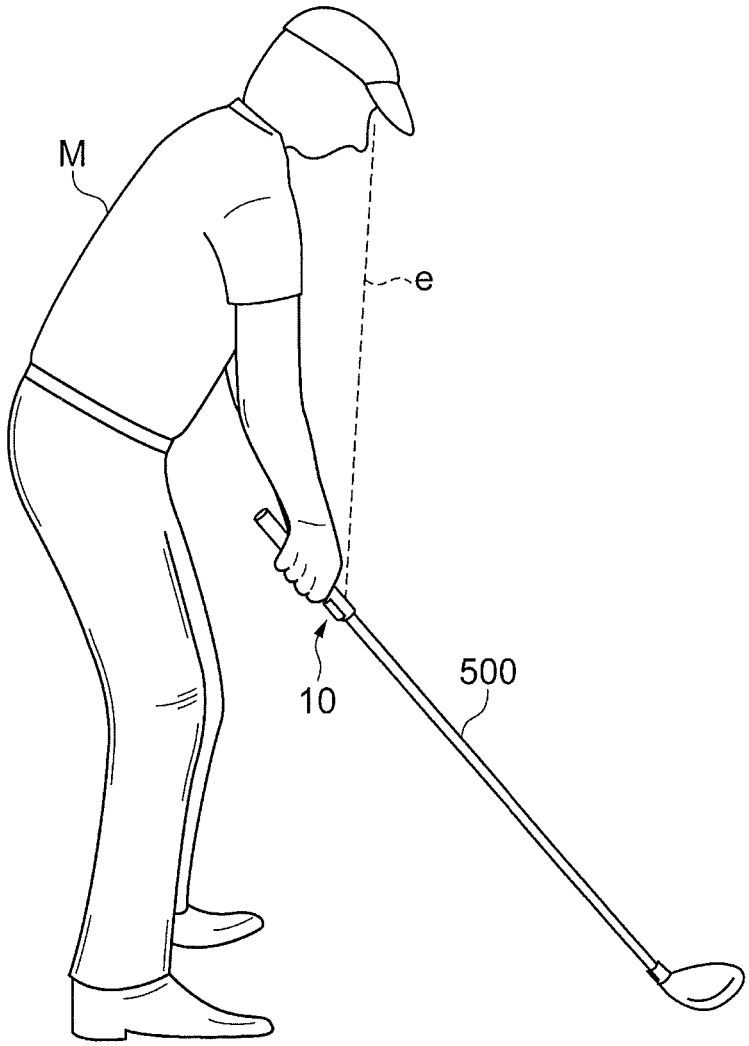
FIG. 4 is a schematic diagram showing a relationship between the motion detection device applied to the sports equipment according to the first embodiment and a test object.

The motion detection device 1 including a sensor unit 10 according to the first embodiment is a device for detecting a motion of a test object M shown in FIG. 4, and using the motion form of the test object M such as a swing trajectory of a golf club 500 or other sports equipment such as a tennis racket or a baseball bat for the motion analysis.

Hereinafter, the case of applying the motion detection device 1 to the golf club 500 will be explained as an example of the embodiment.

Figure 2:
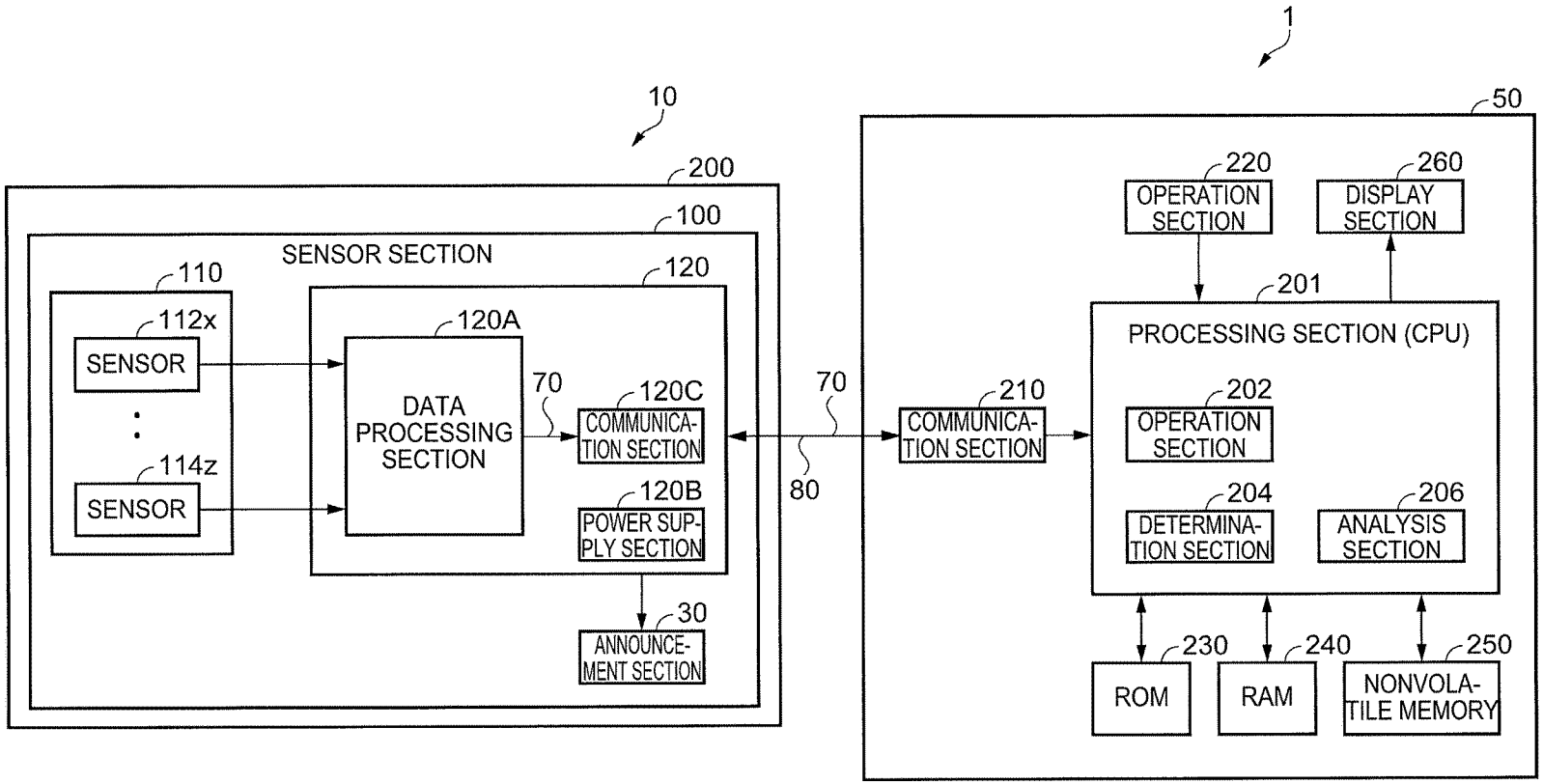
FIG. 2 is a block diagram showing a schematic configuration of a motion detection device according to the first embodiment centered on an analysis unit.
Figure 5:
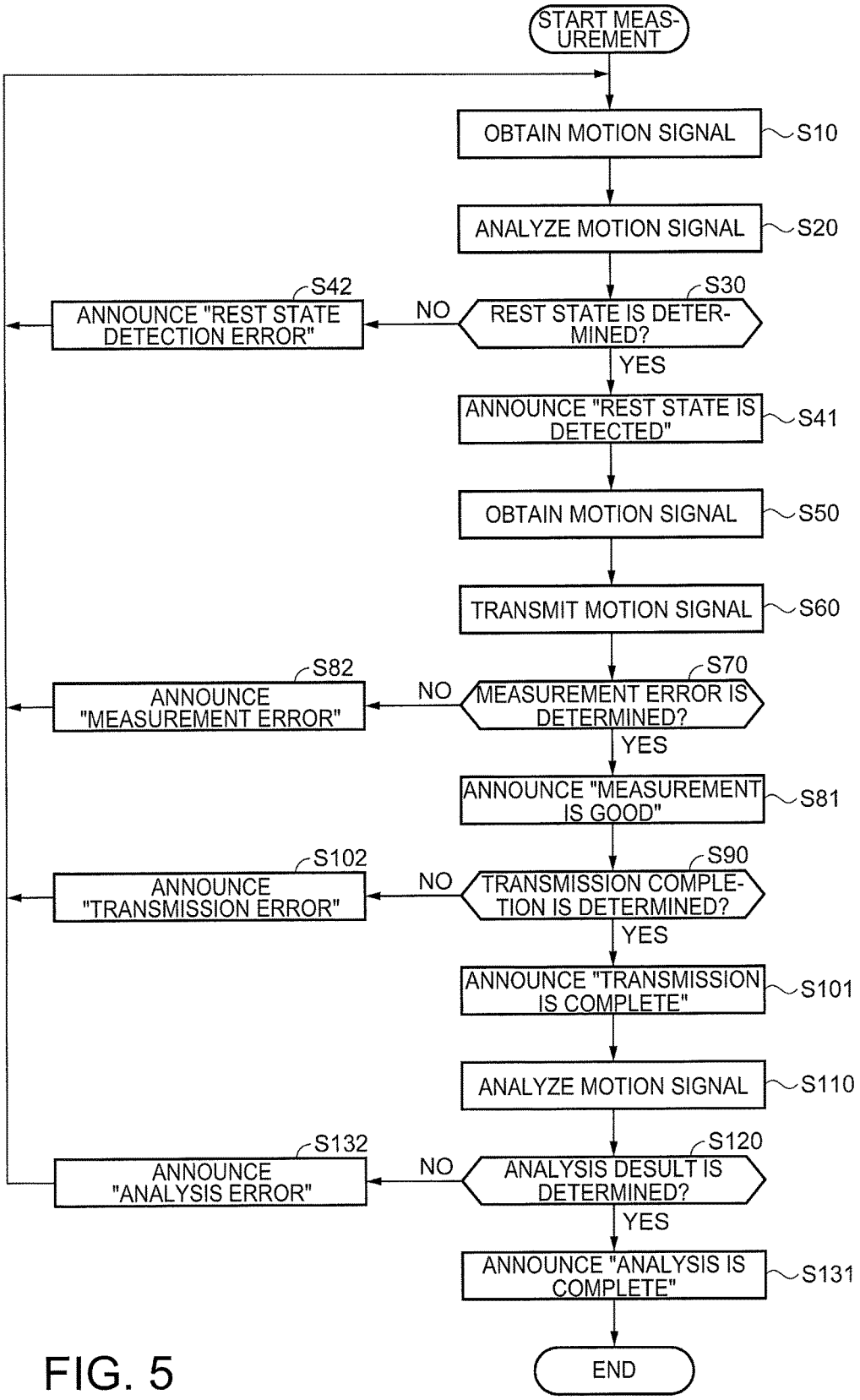
FIG. 5 is a flowchart for explaining processes of the motion detection method according to the first embodiment.

FIG. 1 is a block diagram showing a schematic configuration of the motion detection device 1 according to the present embodiment, and is a diagram mainly showing a schematic configuration of a sensor section 100 of the sensor unit 10. FIG. 2 is a block diagram showing a schematic configuration of the motion detection device 1 according to the present embodiment, and is a diagram mainly showing a schematic configuration of an analysis unit 50. FIGS. 3A through 3C are schematic diagrams showing an example of applying the motion detection device 1 to the golf club 500, wherein the analysis unit 50 is omitted. FIG. 4 is a schematic diagram showing a relationship with the test object M in the case of applying the motion detection device 1 to the golf club 500. FIG. 5 is a flowchart showing an outline of a motion analysis method using the motion detection device 1. FIG. 6 is a diagram showing an example of announcement patterns in an announcement section 30 for informing the test object M with a variety of states of the motion detection device 1.

Configuration of Motion Detection Device 1

The motion detection device 1 shown in FIGS. 1, 2, and 3A through 3C is configured including the sensor unit 10, the announcement section 30, and the analysis unit 50.

Configuration of Sensor Unit 10

The sensor unit 10 is configured including the sensor section 100, a housing 130 for housing the sensor section 100, and a holding section 200.

Configuration of Sensor Section 100

The sensor section 100 is configured including the announcement section 30, a sensor 110, and a control section 120. Further, the sensor section 100 is housed in the housing 130 described later.

Sensor 110

The sensor 110 is capable of detecting a predetermined physical quantity due to the motion, and then outputting a signal corresponding to the physical quantity such as acceleration, angular velocity, velocity, or angular acceleration thus detected.

The sensor 110 is provided with three-axis detection acceleration sensors 112*x*, 112*y*, and 112*z* (hereinafter collectively referred to as "three-axis acceleration sensors") for detecting the acceleration in X-axis, Y-axis, and Z-axis directions. Further, the sensor 110 is provided with three-axis detection gyro sensors (angular velocity sensors) 114*x*, 114*y*, and 114*z* (hereinafter collectively referred to as "three-axis gyro sensors") for detecting the angular velocity in the X-axis, Y-axis, and Z-axis directions. The sensor 110 is provided as a six-axis detection motion sensor including the three-axis acceleration sensors and the three-axis gyro sensors.

Here, as the three-axis gyro sensors (the angular velocity sensors) 114*x* through 114*z*, there can be used vibrating angular velocity sensors. The vibrating angular velocity sensor vibrates a vibrating body at a constant frequency. When the acceleration is applied to the vibrating body, a Coriolis force is generated, and the vibrating body vibrates in a different direction due to the Coriolis force. By detecting the displacement due to the Coriolis force to thereby detect the angular velocity, the physical quantity due to the motion can be detected.

It should be noted that in the motion detection device 1 according to the present embodiment, the configuration of the sensor 110 is not particularly limited, but can arbitrarily be changed in accordance with the measurement object on which the motion detection is performed.

Control Section 120

The control section 120 is configured including a data processing section 120A, a power supply section 120B, and a communication section 120C. To the control section 120, there are connected the sensors 112*x* through 112*z*, and 114*x* through 114*z*, the announcement section 30 described later, and the analysis unit 50.

The data processing section 120A performs packet data conversion on the output signals of the sensors 112*x* through 112*z*, and 114*z* through 114*z* together with, for example, temporal information (time base). Further, the data processing section 120A transmits the signal obtained by the packet data conversion to the communication section 120C. It should be noted that in the explanation below, the signal obtained by converting the output signals of the sensors 112*x* through 112*z*, and 114*z* through 114*z* into the packet data is referred to as a "motion output signal 70."

The communication section 120C performs a process of transmitting the motion output signal 70 (the packet data), which has been transmitted from the data processing section 120A, to the analysis unit 50. It should be noted that the transmission method between the sensor unit 10 and the analysis unit 50 is not particularly limited, and wireless communication or the like can be used.

The control section 120 is provided with the power supply section 120B, which supplies electric power necessary for the operations of the sensor 110, the control section 120, and so on. The configuration of the power supply section 120B is not particularly limited, and a primary battery (e.g., a dry-cell battery or a lithium battery) and a secondary battery (e.g., a nickel-metal-hydride battery or a lithium-ion battery) can be used. It should be noted that the power supply section 120B can also be provided to the analysis unit 50 to supply the sensor section 100 with the electric power.

Configuration of Holding Section 200

The holding section 200 is an attachment for attaching the sensor section 100 to the sports equipment, which is the detection object of the motion detection device 1, in order to detect the swing trajectory of the sports equipment.

The holding section 200 is the attachment for attaching the sensor section 100 to the sports equipment such as the golf club 500 as shown in FIG. 3B in the case of applying the motion detection device 1 to the golf club 500. The shape of the holding section 200 is not particularly limited, but is only required to make it possible to mount the sensor section 100 on a shaft 500*s* or a grip 500*g* and at the same time attach the sensor section 100 so as to be detachably fitted in the case of applying the motion detection device 1 to the golf club 500. Further, it is preferable for the sensor section 100 to be attached to the golf club 500 so that the announcement section 30 described later face to the same direction as an end of the grip 500*g*. It should be noted that the holding section 200 can also be changed arbitrarily in accordance with the type of the sports equipment.

Configuration of Announcement Section 30

As shown in FIGS. 1 and 2, the announcement section 30 is provided to the sensor section 100. As shown in FIGS. 3A through 3C, the announcement section 30 is configured including light emitting sections 132. The announcement section 30 is provided for visually announcing the state of the output signal of the sensor section 100 and a variety of states of the motion detection device 1 to the test object M. The announcement section 30 is for announcing the state of the output signal of the sensor section 100 and a variety of states of the motion detection device 1 to the test object M using the blink of the light emitting sections 132. The announcement section 30 of the motion detection device 1 according to the present embodiment is configured including a first light emitting section 132*a* and a second light emitting section 132*b* as an example. The first light emitting section 132*a* and the second light emitting section 132*b* use a light emitting element such as a light emitting diode, and are therefore capable of emitting light with a plurality of colors (e.g., red and green). Therefore, the announcement section 30 can announce the state of the motion output signal 70 of the sensor section 100 and a variety of states of the motion detection device 1 using the difference in color of the light emitted by the light emitting sections 132.

It should be noted that it is preferable for the announcement section 30 to be disposed on a side surface (an exterior surface) of the housing 130 of the sensor section 100.

For example, in the case of mounting the sensor unit 10 on the back side of the shaft 500*s* of the golf club 500 described later, if the announcement section 30 is disposed only on the obverse surface of the housing 130, the test object M is hindered from visually recognizing (sensing) the light emission by the announcement section 30 in some cases. Therefore, by disposing the announcement section 30 also on the side surface of the housing 130, it is possible to make the test object M visually recognize (sense) the light emission by the announcement section 30 irrespective of the mounting configuration of the sensor unit 10. Further, it is preferable for the announcement section 30 to be disposed on the both ends in the width direction (e.g., a direction intersecting with the direction in which the shaft 500*s* extends) of the housing 130 of the sensor unit 10. In the swing of the golf club 500, it is possible to make the test object M visually recognize (sense) the light emission by the announcement section 30 irrespective of the dominant arm.

Configuration of Analysis Unit 50

Going back to FIG. 2, the configuration of the analysis unit 50 will be explained.

As shown in FIG. 2, the analysis unit 50 is configured including a processing section (CPU) 201, a communication section 210, an operation section 220, a ROM 230, a RAM 240, a nonvolatile memory 250, and a display section 260.

The communication section 210 performs a process of receiving the motion output signal 70 (the packet data) transmitted from the sensor unit 10, and then transmitting the motion output signal 70 to the processing section 201. The operation section 220 performs a process of obtaining operation data from the test object M or a subsidiary (not shown), and then transmitting the operation data to the processing section 201. The ROM 230 stores a program for the processing section 201 to perform a variety of calculation processes and control processes, and various programs, data, and so on to realize application functions. The RAM 240 is a storage section used as a working area of the processing section 201, and temporarily storing, for example, the program and data retrieved from the ROM 230, the data input from the operation section 220, and the result of the calculation performed by the processing section 201 with the various programs and application functions. The display section 260 is for displaying the processing result of the processing section 201 as letters, graphs, or other images. The display section 260 corresponds to, for example, a CRT, an LCD, and a touch panel display. It should be noted that it is also possible to arrange that the functions of the operation section 220 and the display section 260 are realized by a single touch panel display.

The processing section 201 is configured including an operation section 202, a determination section 204, and an analysis section 206. The processing section 201 performs a variety of calculation processes, analysis processes, determination processes, etc. on the motion output signal 70 received from the sensor unit 10 via the communication section 210 in accordance with the program stored in the ROM 230.

The processing section 201 performs the operational treatment of the motion output signal 70 transmitted from the sensor unit 10 using the operation section 202. Further, the processing section 201 performs the determination on whether or not the test object M is in the rest state based on the result of the operational treatment using the determination section 204, and at the same time stores a bias value of the sensor 110 in the RAM 240. In other words, the determination section 204 determines whether or not the golf club 500 attached with the sensor unit 10 is in an origin state of the swing.

Further, the processing section 201 performs the operational treatment of the motion output signal 70 transmitted from the sensor unit 10 using the operation section 202. The processing section 201 performs the determination on whether or not the motion detection has appropriately been performed based on the result of the operational treatment using the determination section 204. Further, the processing section 201 performs the motion analysis of the measurement object based on the result of the operational treatment using the analysis section 206. The processing section 201 transmits a trigger (result) signal 80 regarding the determination on the rest state, the determination on the appropriateness of the motion detection, the completion of the motion analysis result, and so on to the announcement section 30.

It should be noted that as the analysis unit 50, a personal computer, a smartphone (including a tablet terminal), or the like having the function described above can be used.

Configuration of Applying Motion Detection Device 1 to Golf Club 500

A configuration of applying the motion detection device 1 to the golf club 500 will be explained.

FIG. 3A is a schematic diagram showing an appearance of the sensor section 100 constituting the sensor unit 10. The sensor section 100 is constituted by the sensor 110 and the control section 120, which are housed in the housing 130. Further, the first light emitting section 132*a* and the second light emitting section 132*b* constituting the announcement section 30 are disposed on the side surface (the exterior surface) of the housing 130.

FIGS. 3B and 3C are diagrams showing the state, in which the sensor unit 10 is attached to the golf club 500, as an example of a practical configuration of the motion detection device 1. As shown in FIG. 3B, the sensor section 100 is attached to the golf club 500 using the holding section 200. Specifically, as shown in FIG. 3C, the sensor section 100 is attached so as to fit into the holding section 200 attached to the shaft 500*s* or the grip 500*g* of the golf club 500. It should be noted that the sensor unit 10 is attached to the golf club 500 so that the light emitting sections 132 (132*a*, 132*b*) of the announcement section 30 face to an end of the grip 500*g*. This is for making it possible for the test object M to visually recognize (sense) the light emission with ease.

FIG. 4 schematically shows a situation in which the test object M grips the golf club 500.

As shown in FIG. 4, in the case in which the swing (motion) of the golf club 500 by the test object M is detected using the motion detection device 1, and then the swing is analyzed using the motion analysis method described later, the test object M can recognize the state of the motion detection device 1 by visually recognizing the light emission by the announcement section 30. Therefore, it is possible for the test object M to make a swing without deviating from the visual line e.

It should be noted that if the housing 130 of the sensor section 100 comes into sight (view field) of the test object M, the test object M is bothered when making a swing, and there is a possibility that the swing becomes different from the usual swing. Therefore, it is preferable for the housing 130 of the sensor section 100 to be mounted on the back side of the shaft 500*s* viewed from the test object M in the rest state (at address) prior to making the swing of the golf club 500. In such a case, by disposing the announcement section 30 on the side surface of the housing 130 of the sensor section 100 as described above, the test object M can visually recognize (sense) presence or absence of the light emission by the announcement section 30 with ease.

Motion Analysis Method

The motion analysis method according to the present embodiment includes a measurement preparation process, a motion measurement process, a transmission process for transmitting the motion output signal 70 obtained in the motion measurement process to the analysis unit 50, and an analysis process for analyzing the motion output signal 70 transmitted in the transmission process. Further, the motion analysis method includes a rest state announcement process for announcing the completion of the measurement preparation process, a measurement completion announcement process for announcing the completion of the motion measurement process, and a transmission completion announcement process for announcing the completion of the transmission of the motion output signal 70 from the sensor unit 10 to the analysis unit 50.

Each of the processes of the motion analysis method using the motion detection device 1 will be explained step by step with reference to the flowchart shown in FIG. 5. It should be noted that as the explanation of the motion analysis method, a motion analysis method with the motion detection device 1 applied to the golf club 500 will be explained.

Measurement Preparation Process

The measurement preparation process is a process for performing the measurement preparation of the motion, and is a process for measuring the bias of the sensor 110 prior to the start of the motion (swing).

Here, the bias is a collective term including a bias occurring in the initial state prior to the start of the motion of the test object M and in which the angular velocity is zero, and a drift due to an external factor such as a power supply fluctuation or a temperature fluctuation.

In the measurement preparation process, the motion output signal 70 output in the case in which the test object M is in the rest state (a so-called address state) while gripping the golf club 500 is obtained by the analysis unit 50 in the step S10.

In the measurement preparation process, the operational treatment of the motion output signal 70 obtained by the analysis unit 50 is performed using the operation section 202 in the step S20.

In the measurement preparation process, the motion output signal 70 operated by the operation section 202 and the value of the motion output signal 70 in the rest state as a first threshold value previously recorded on the ROM 230 are compared to each other, and then a first determination on whether or not the motion output signal 70 becomes lower than the value of the motion output signal 70 in the rest state as the first threshold in a certain period is performed by the determination section 204 in the step S30. It should be noted that the certain period for the determination is arbitrarily set in accordance with the measurement object, and is set to 3 seconds in the present embodiment. In the case in which it is determined in the step S30 that the motion output signal 70 is within the range of the rest state, the process proceeds to the announcement of "REST STATE IS DETECTED" in the step S41, and at the same time, the motion output signal 70 at that moment is stored in the RAM 240 as the bias value. Further, in the case in which it is determined in the step S30 that the motion output signal 70 is out of the range of the rest state, the announcement of "REST STATE DETECTION ERROR" in the step S42 is performed, and then the process returns to the step S10 to begin again with the acquisition of the motion output signal 70 in the rest state.

Rest State Announcement Process

The rest state announcement process is a process of announcing the result of the determination on whether or not the golf club 500 and the test object M gripping the golf club 500 are in the rest (address) state based on the motion output signal 70 in the measurement preparation process described above.

In the rest state announcement process, in the case in which it is determined in the step S30 that the golf club 500 and the test object M gripping the golf club 500 are in the rest state based on the motion output signal 70, the announcement of "REST STATE IS DETECTED" is performed in the step S41. The present announcement is also an announcement of the start of the motion of the measurement object.

Further, in the rest state announcement process, in the case in which it is determined in the step S30 that the golf club 500 and the test object M gripping the golf club 500 are not in the rest state based on the motion output signal 70, the announcement of "REST STATE DETECTION ERROR" is performed in the step S42.

The rest state announcement process is performed by the light emitting sections 132 provided to the announcement section 30. Here, the announcement of "REST STATE IS DETECTED" by the announcement section 30 is performed using the blink and the emission colors of the first light emitting section 132*a* and the second light emitting section 132*b*. The announcement section 30 can change the emission colors and the blinking patterns in accordance with the information to be announced to the test object M. FIG. 6 shows an example of the emission colors and the blinking patterns of the light emitting sections 132 of the announcement section 30.

The announcement of "REST STATE IS DETECTED" in the step S41 is performed using the emission colors and the announcement (blinking) patterns shown in the announcement class 3 of FIG. 6 as an example. In the announcement class 3, the emission color of the first light emitting section 132*a* is set to green, and the first light emitting section 132*a* is made to emit the light for a predetermined time, while the second light emitting section 132*b* is kept OFF. Thus, the announcement of "REST STATE IS DETECTED" is provided to the test object M.

The announcement of "REST STATE DETECTION ERROR" in the step S42 is performed using the emission colors and the announcement (blinking) patterns shown in the announcement class 7 of FIG. 6 as an example. In the announcement class 7, the emission color of the second light emitting section 132*b* is set to red, and the second light emitting section 132*b* is made to emit the light for a predetermined time, while the first light emitting section 132*a* is kept OFF. Thus, the test object M is provided with the announcement of "REST STATE DETECTION ERROR," and at the same time, prompted to further keep the rest (address) state.

Motion Measurement Process

The motion measurement process is a process of measuring the motion (swing) of the test object M gripping the golf club 500. The motion measurement process is a process of performing the measurement of the motion (swing) of the test object M using the sensor 110 installed in the sensor unit 10.

In the motion measurement process, the acceleration and so on due to the motion of the test object M is obtained as the motion output signal 70 from the sensor unit 10 in the step S50.

Transmission Process

The transmission process is a process of transmitting the motion output signal 70 based on the motion (swing) of the test object M gripping the golf club 500 obtained in the motion measurement process to the analysis unit 50.

In the transmission process, the motion output signal 70 obtained in the step S50 is transmitted from the sensor unit 10 to the analysis unit 50.

In the transmission process, a second determination on whether or not an error (e.g., over range or missing) is included in the motion output signal 70 transmitted to the analysis unit 50 in the step S60 is performed by the determination section 204 in the step S70. Further, in the transmission process, the second determination on whether or not the acceleration and so on due to the motion exceed a predetermined value is performed by the determination section 204 in the step S70 based on the motion output signal 70 transmitted to the analysis unit 50 in the step S60.

The error determination is performed by comparison with the normal motion output signal 70 previously recorded on the ROM 230 as a second threshold value. Further, the determination of the acceleration and so on due to the motion is performed by comparison with the motion output signal 70 previously recorded on the ROM 230 as the second threshold value. It should be noted that the determination of the acceleration and so on due to the motion can also be performed using an arbitrary value of the motion output signal 70 such as the maximum value or the minimum value of the motion output signal 70 of the test object M as the second threshold value.

In the case in which it is determined in the step S70 that no error is included in the motion output signal 70, or in the case in which the motion output signal 70 exceeds the predetermined second threshold value (in the case in which the condition of the threshold is fulfilled), the process proceeds to the announcement of "MEASUREMENT IS GOOD" in the step S81. Further, in the case in which it is determined in the step S70 that the motion output signal 70 includes an error, the process proceeds to the announcement of "MEASUREMENT ERROR" in the step S82, and then the process returns to the step S10 to perform the motion analysis again from the acquisition of the motion output signal 70 in the rest state.

The announcement of "MEASUREMENT IS GOOD" in the step S81 is performed using the emission colors and the announcement (blinking) patterns shown in the announcement class 2 of FIG. 6 as an example. In the announcement class 2, the emission color of the first light emitting section 132*a* is set to red, while the emission color of the second light emitting section 132*b* is set to green. In the announcement class 2, the first light emitting section 132*a* and the second light emitting section 132*b* are made to emit the light alternately. Thus, the announcement of "MEASUREMENT IS GOOD" is provided to the test object M.

Further, the announcement of "MEASUREMENT ERROR" in the step S82 is performed using the emission colors and the announcement (blinking) patterns shown in the announcement class 1 of FIG. 6 as an example. In the announcement class 1, the emission colors of the first light emitting section 132*a* and the second light emitting section 132*b* are set to red, and the first light emitting section 132*a* and the second light emitting section 132*b* are made to emit the light simultaneously at regular intervals. Thus, the test object M is provided with the announcement of "MEASUREMENT ERROR," and at the same time, prompted to perform the motion analysis again from the acquisition of the motion output signal 70 in the rest state in the step S10.

In the transmission process, the determination of the completion of the transmission of the motion output signal 70 transmitted to the analysis unit 50 in the step S60 is performed by the determination section 204 in the step S90. The determination of the completion of the transmission is performed by receiving the start parity and the stop parity added by the data processing section 120A provided to the sensor unit 10 to the motion output signal 70 (the packet data) to be transmitted. In the case in which the stop parity can be received before a predetermined time previously stored in the ROM 230 elapses after receiving the start parity in the step S90, it is determined that the transmission is completed, and the process proceeds to the announcement of "TRANSMISSION IS COMPLETE" in the step S101. Further, in the case in which the stop parity fails to be received before the predetermined time elapses, the process proceeds to the announcement of "TRANSMISSION ERROR" in the step S102, and then the process returns to the step S10 to perform the motion analysis again from the acquisition of the motion output signal 70 in the rest state.

The announcement of "TRANSMISSION IS COMPLETE" in the step S101 is performed using the emission colors and the announcement (blinking) patterns shown in the announcement class 4 of FIG. 6 as an example. In the announcement class 4, the emission color of the second light emitting section 132*b* is set to green. In the announcement class 2, the first light emitting section 132*a* is kept OFF, while the second light emitting section 132*b* is made to emit the light at regular intervals. Thus, the announcement of "TRANSMISSION IS COMPLETE" is provided to the test object M.

Further, the announcement of "TRANSMISSION ERROR" in the step S102 is performed using the emission colors and the announcement (blinking) patterns shown in the announcement class 6 of FIG. 6 as an example. In the announcement class 6, the emission color of the first light emitting section 132*a* is set to red, while the emission color of the second light emitting section 132*b* is set to green. The first light emitting section 132*a* and the second light emitting section 132*b* are made to emit the light simultaneously at regular intervals. Thus, the test object M is provided with the announcement of "TRANSMISSION ERROR," and at the same time, prompted to perform the motion analysis again from the acquisition of the motion output signal 70 in the rest state in the step S10.

Analysis Process

The analysis process is a process of analyzing the motion output signal 70, which is based on the motion (swing) of the test object M gripping the golf club 500, obtained in the motion measurement process, and then transmitted to the analysis unit 50.

In the motion analysis process, the analysis of the motion output signal 70 based on the motion (swing) of the test object M transmitted to the analysis unit 50 is performed in the step S110 based on a predetermined analysis program stored in the ROM 230. Further, in the motion analysis process, the analysis result is displayed on (output to) the display section 260.

In the motion analysis process, the determination of the result obtained by the analysis in the step S110 is performed by the determination section 204 in the step S120. The determination of the analysis result is performed based on the analysis result previously stored in the ROM 230.

In the motion analysis process, the analysis result of the motion output signal 70 analyzed in the step S110 and an analysis result (hereinafter referred to as a "reference analysis result") in a predetermined range previously recorded on the ROM 230 are compared to each other, and the determination on whether or not the analysis result is within the range of the reference analysis result is performed by the determination section 204 in the step S120.

In the case in which it is determined in the step S120 that the analysis result is within the range of the reference analysis result, the process proceeds to the announcement of "ANALYSIS IS COMPLETE" in the step S131. Further, in the case in which it is determined in the step S120 that the analysis result is out of the range of the reference analysis result, the process proceeds to the announcement of "ANALYSIS ERROR" in the step S132, and then the process returns to the step S10 to begin again with the acquisition of the motion output signal 70 in the rest state.

The announcement of "ANALYSIS IS COMPLETE" in the step S131 is performed using the emission colors and the announcement (blinking) patterns shown in the announcement class 8 of FIG. 6 as an example. In the announcement class 8, the emission colors of the first light emitting section 132*a* and the second light emitting section 132*b* are set to green. In the announcement class 8, the first light emitting section 132*a* and the second light emitting section 132*b* are made to emit the light simultaneously at regular intervals. Thus, the announcement of "ANALYSIS IS COMPLETE" is provided to the test object M.

Further, the announcement of "ANALYSIS ERROR" in the step S132 is performed using the emission colors and the announcement (blinking) patterns shown in the announcement class 5 of FIG. 6 as an example. The emission colors of the first light emitting section 132*a* and the second light emitting section 132*b* are set to red. In the announcement class 5, the first light emitting section 132*a* and the second light emitting section 132*b* are made to emit the light simultaneously at regular intervals. Thus, the test object M is provided with the announcement of "ANALYSIS ERROR," and at the same time, prompted to perform the motion analysis again from the acquisition of the motion output signal 70 in the rest state in the step S10.

The series of processes of the motion analysis method are completed with the announcement of "ANALYSIS IS COMPLETE" in the step S131.

It should be noted that in the motion analysis method described above, the steps on and after the announcement of "REST STATE IS DETECTED" in the step S41 are performed continuously. Further, in the analysis method described above, the announcements in the respective steps on and after the announcement of "REST STATE IS DETECTED" in the step S41 can arbitrarily be omitted or added.

According to the motion detection device 1 related to the first embodiment described above, the following advantages can be obtained.

According to such a motion detection device 1, it is possible to make the test object M gripping the sports equipment visually recognize the state of the motion detection device 1 using the light emission by the announcement section 30 without losing the posture.

Therefore, according to such a motion detection device 1, it is possible for the test object M to make a motion (swing) while gripping the sports equipment without diverting the visual line e and the attention. Therefore, the natural motion (swing) posture can be detected, and thus, the reliability of the motion analysis can be enhanced.

Second Embodiment

A motion detection device according to a second embodiment will be explained using FIGS. 7 through 8.

Figure 7:
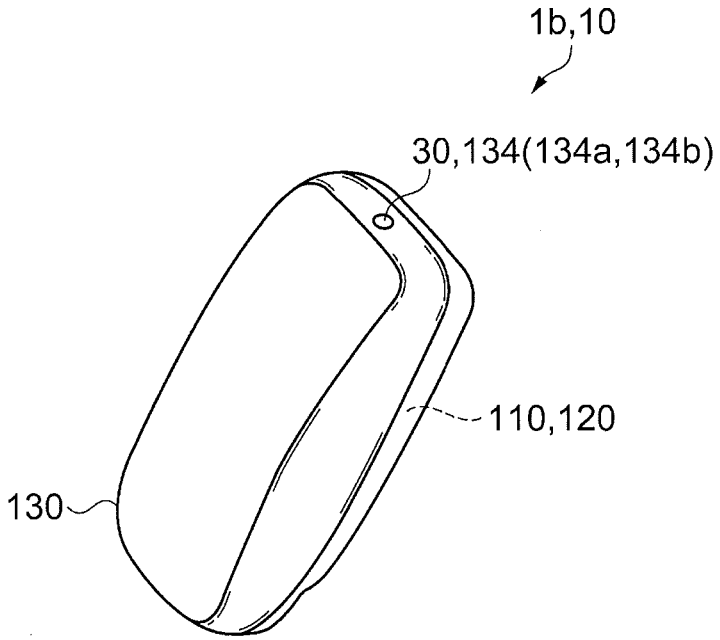
FIG. 7 is a diagram schematically showing a motion detection device according to a second embodiment of the invention.

FIG. 7 is a diagram schematically showing a sensor section 100 of the motion detection device 1*b* according to the second embodiment. FIG. 8 is a diagram showing an example of the announcement patterns of the announcement section 30 provided to the sensor section 100. It should be noted that in the motion detection device 1*b* shown in FIG. 7, the graphical description is outlined except the sensor section 100.

The motion detection device 1*b* according to the second embodiment is different in the configuration of the announcement section 30 compared to the motion detection device 1 explained in the description of the first embodiment.

Other configurations and the motion analysis method are roughly the same as those of the motion detection device 1 and the motion analysis method in the above description of the first embodiment. Therefore, the motion detection device 1*b* will be explained while roughly the same configurations are denoted with the same reference symbols or the same reference numbers, and partially omitted from the explanation.

Structure of Motion Detection Device 1*b*

The sensor unit 10 constituting the motion detection device 1*b* according to the present embodiment is configured including the sensor section 100 and the holding section 200 (not shown in FIG. 7). The sensor section 100 is configured including the announcement section 30, the sensor 110, and the control section 120, which are housed in the housing 130.

Configuration of Announcement Section 30

Similarly to the motion detection device 1 in the description of the first embodiment, the sensor section 100 is provided with the announcement section 30.

The announcement section 30 is configured including acoustic sections 134. The announcement section 30 is provided for aurally announcing various states of the motion detection device 1*b* to the test object M. The announcement section 30 is for announcing the various states of the motion detection device 1*b* to the test object M with sounds generated by the acoustic sections 134. The announcement section 30 of the motion detection device 1*b* according to the present embodiment is configured including, as an example, a first acoustic section 134*a* for sounding with a high note (a high pitch sound) and a second acoustic section 134*b* for sounding with a low note (a low pitch sound).

Motion Analysis Method

The motion analysis method using the motion detection device 1*b* according to the present embodiment is roughly the same as the motion analysis method using the motion detection device 1 in the above description of the first embodiment, but is different in the announcement patterns for announcing the states of the motion detection device 1*b* to the test object M.

In the method of announcing the states of the motion detection device 1*b* to the test object M adopted in the motion analysis method according to the present embodiment, the announcement is aurally performed using the sounds generated by the acoustic sections 134. Further, the announcement is performed using the combinations of the pitches of the first acoustic section 134*a* and the second acoustic section 134*b*. It is possible for the motion detection device 1*b* to announce a plurality of pieces of information such as the states of the motion detection device 1*b* and the analysis result of the motion output signal 70 by changing the intervals of the sounds generated by the acoustic sections.

The announcements in the motion analysis method according to the present embodiment are performed using the announcement patterns set in the announcement classes 11 through 18 shown in FIG. 8 corresponding to the announcement classes 1 through 8 shown in FIG. 6 in the announcements of the motion analysis method in the description of the first embodiment. Further, the first acoustic section 134*a* and the second acoustic section 134*b* in the motion detection device 1*b* correspond to the first light emitting section 132*a* and the second light emitting section 132*b* in the motion detection device 1. Specifically, the announcements are performed replacing the light emission by the light emitting sections 132 with the sounding by the acoustic sections 134, and replacing the emission colors of the light emitting sections 132 with the pitches (the high note and the low note) of the acoustic sections 134.

Other parts of the configuration of the motion detection device 1*b* and the motion analysis method using the motion detection device 1*b* are substantially the same as those of the configuration of the motion detection device 1 and the motion analysis method using the motion detection device 1 in the description of the first embodiment, and therefore the explanation thereof will be omitted.

According to the motion detection device 1*b* related to the second embodiment described above, the following advantages can be obtained.

According to such a motion detection device 1*b*, it is possible to make the test object M gripping the sports equipment aurally recognize the state of the motion detection device 1*b* using the sounds generated by the announcement section 30 without losing the posture. Therefore, according to such a motion detection device 1*b*, it is possible for the test object M to make a motion (swing) while gripping the sports equipment without diverting the visual line e and the attention. Therefore, the natural motion (swing) posture can be detected, and thus, the reliability of the motion analysis can be enhanced.

MODIFIED EXAMPLES

It should be noted that the invention is not limited to the embodiments described above, but various modifications or improvements can be provided to the embodiments described above. Some modified examples will be described below.

Modified Example 1

Figure 9:
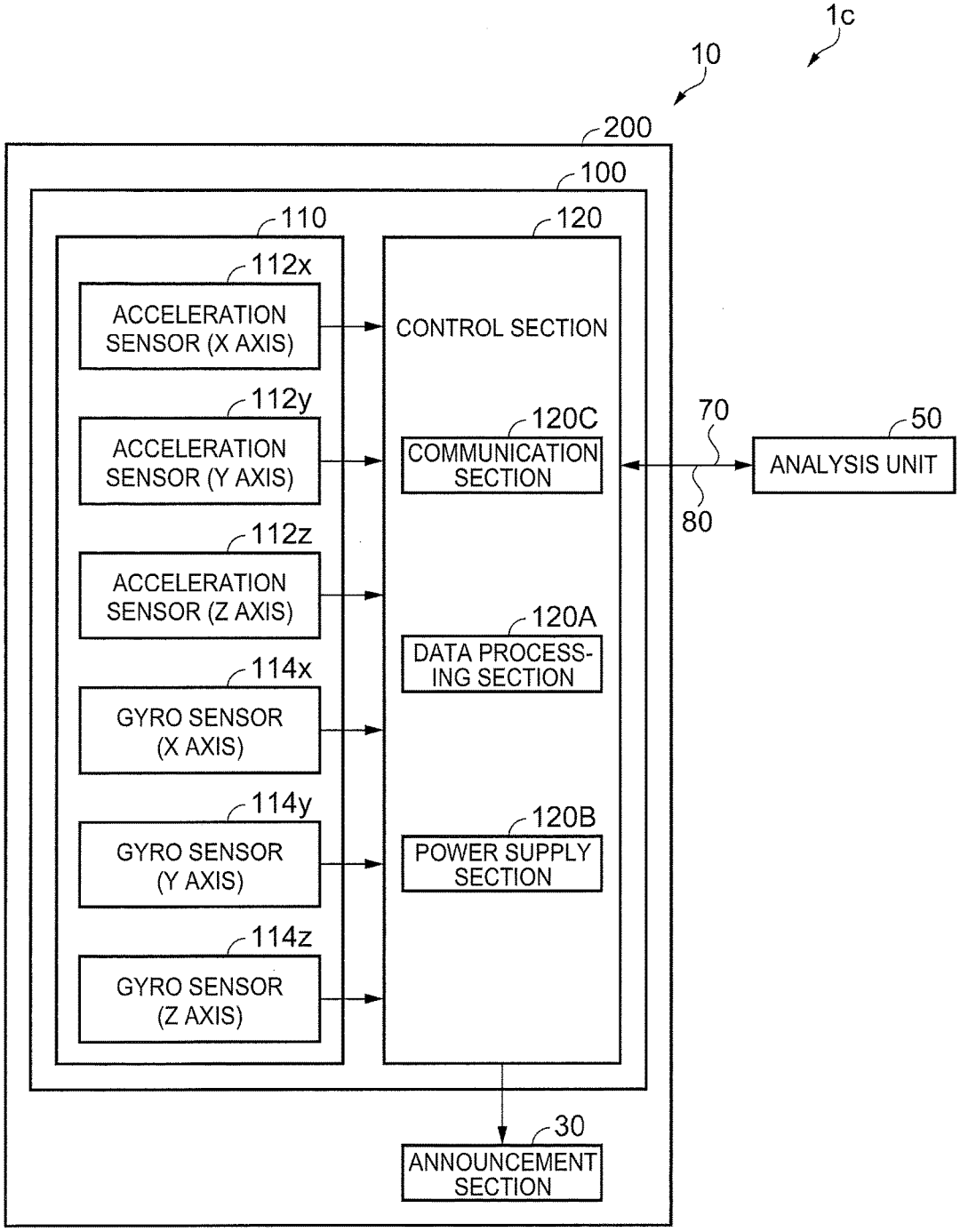
FIG. 9 is a block diagram showing a schematic configuration of a motion detection device according to a modified example.

FIG. 9 is a block diagram showing a schematic configuration of a motion detection device according to modified example 1.

In the first embodiment and the second embodiment described above, the announcement section 30 is provided to the sensor section 100 of the sensor unit 10. However, the invention is not limited to this configuration, but the announcement section 30 can also be provided to the holding section 200 as shown in FIG. 9. It is sufficient that the test object M can sense the light and the sound generated by the announcement section 30, and the visual line e for visually recognizing the light emission of the light emitting sections 132 is not blocked.

Thus, it is possible to suppress the eccentricity of the centroid of the sports equipment such as the golf club 500 to thereby realize the motion detection and the motion analysis with higher accuracy.

Modified Example 2

In the first embodiment and the second embodiment, the announcement section 30 announces a variety of states with the light or the sound to make the test object M sense the states. However, the invention is not limited to this configuration, but it is possible for the announcement section 30 to announce a variety of states using vibrations, and conduct the vibrations to the test object M via the sports equipment attached with the sensor unit 10 to thereby make the test object M sense the states.

Thus, it is possible to give an announcement only to the test object M, and thus, it is possible to inhibit the test object M from misidentifying the light and the sound from other than the motion detection device as the announcement to itself to thereby realize the motion detection and the motion analysis with high reliability.

What is claimed is:

1. A sensor unit comprising:

a sensor section adapted to detect a motion of a measurement object; and an announcement section coupled to the sensor section and adapted to announce whether or not the measurement object is in a rest state, the announcement section announcing that the measurement object is in the rest state in response to the sensor section detecting that the motion corresponds to the rest state for a predetermined time period, the announcement section announcing that the measurement object is in the rest state by emitting a predetermined one of a plurality of light patterns, or a predetermined one of a plurality of sound patterns, wherein the predetermined one of the plurality of light patterns includes a first light emitting section emitting a first color light for a first time period while a second light emitting section is prevented from emitting a second, different color light for the first time period, and the predetermined one of the plurality of sound patterns includes a first acoustic section emitting a first pitch for the first time period while a second acoustic section is prevented from emitting a second, different pitch for the first time period.

2. The sensor unit according to claim 1, wherein the announcement section performs a first determination on whether or not a value of an output signal of the sensor section becomes lower than a first threshold value in a predetermined period, and announces a result of the first determination.

3. A sensor unit comprising:

a sensor section adapted to detect a motion of a measurement object; and an announcement section coupled to the sensor section and adapted to perform a determination on whether or not a value of an output signal of the sensor section exceeds a threshold value, and announce a result of the determination that the output signal is in error in the case that the value of the output signal does not exceed the threshold value.

4. The sensor unit according to claim 1, wherein the announcement section announces whether or not transmission of an output signal of the sensor section to another device connected to the sensor unit is complete.

5. The sensor unit according to claim 1, further comprising:

a housing adapted to house the sensor section, wherein at least a part of the announcement section is disposed on a side surface of the housing.

6. The sensor unit according to claim 1, further comprising:

a holder adapted to attach a housing to the measurement object, the housing being fit into the holder, the holder adapted to house the sensor section, wherein at least a part of the announcement section is provided across ends of the holder.

7. A motion detection device comprising:

the sensor unit according to claim 1; and a processor adapted to analyze the motion of the measurement object.

8. A motion detection device comprising:

the sensor unit according to claim 3; and a processor adapted to analyze the motion of the measurement object.

9. The motion detection device according to claim 7, wherein the sensor unit transmits an output signal of the sensor section to the processor, the processor analyzes the output signal, and then transmits a trigger signal to the announcement section of the sensor unit when a predetermined condition is fulfilled, and the announcement section makes an announcement upon reception of the trigger signal.

10. The motion detection device according to claim 8, wherein the sensor unit transmits an output signal of the sensor section to the processor, the processor analyzes the output signal, and then transmits a trigger signal to the announcement section of the sensor unit when a predetermined condition is fulfilled, and the announcement section makes an announcement upon reception of the trigger signal.

11. The sensor unit according to claim 1, the announcement section adapted to announce when the measurement object is in the rest state and to announce when the measurement object is not in the rest state.

12. The sensor unit according to claim 3, the announcement section adapted to announce when the measurement object is in the rest state and to announce when the measurement object is not in the rest state.

13. A sensor unit comprising:

a sensor adapted to detect a motion of a measurement object;

a processor adapted to determine, based on the detected motion of the measurement object, whether the measurement object is in the rest state or is not in the rest state;

an announcement device adapted to announce that the measurement object is in the rest state when the processor determines that the measurement object is in the rest state, and to announce that the measurement object is not in the rest state when the processor determines that the measurement object is not in the rest state, the announcement device announcing that the measurement object is in the rest state in response to the sensor detecting that the motion corresponds to the rest state for a predetermined time period, the announcement device announcing that the measurement object is in the rest state by emitting a predetermined one of a plurality of light patterns, or a predetermined one of a plurality of sound patterns, wherein the predetermined one of the plurality of light patterns includes a first light emitting section emitting a first color light for a first time period while a second light emitting section is prevented from emitting a second, different color light for the first time period, and the predetermined one of the plurality of sound patterns includes a first acoustic section emitting a first pitch for the first time period while a second acoustic section is prevented from emitting a second, different pitch for the first time period.

14. The sensor unit according to claim 1, the announcement section including an output unit adapted to provide signals to a user, the announcement section being adapted to announce a plurality of states of the sensor unit using differences in the signals provided to the user.

* * * * *